United States Patent [19]

Dieter

[11] Patent Number: 4,867,329

[45] Date of Patent: Sep. 19, 1989

[54] DISPLAY TRAY FOR FISH AND DELICATESSEN PRODUCTS

[76] Inventor: Irene F. Dieter, 322 Hacienda Ave., San Lorenzo, Calif. 94580

[21] Appl. No.: 216,225

[22] Filed: Jul. 7, 1988

[51] Int. Cl.[4] ..... B65D 1/34; B65D 6/04

[52] U.S. Cl. ..... 220/22.1; 206/557; 206/561

[58] Field of Search ..... 220/22.1, 22.3; 206/557, 561

[56] References Cited

U.S. PATENT DOCUMENTS 1,954,224 4/1934 Piker ..... 206/561 X 2,174,689 10/1939 Cox et al. ..... 206/561 X

*Primary Examiner*—Allen M. Ostrager

*Attorney, Agent, or Firm*—Linval B. Castle

[57] ABSTRACT

An invertable tray for holding and displaying fish or deli products in a commercial refrigerated display case. In one form for displaying fish or other wet products, the tray has an elongated arched center with side walls, the junction being a trough for drainage of the fluids so that the product will not be laying in the fluid. Lateral spaced slits cut through the center of the tray support removable dividers. In the inverted state, the arched central portion is a partitioned bowl and the side walls now form supporting pedestal legs.

8 Claims, 1 Drawing Sheet

DISPLAY TRAY FOR FISH AND DELICATESSEN PRODUCTS

BACKGROUND OF THE INVENTION

This invention relates generally to food display trays and particularly to a novel invertable tray which, in one position, is arched to provide side drain troughs for wet products and, when inverted, is an elongated partitionable bowl for the display of drier products.

The display tray of the invention is in the form of a "W" with a raised arched center and side walls. Wet products lying on the center arch thus drain into the recesses formed between the side walls and the center so that the product is raised and is not lying in fluid. An additional feature of the arched tray in this position is that products such as fish lying on the arched center will appear to a customer as a great quantity of the product piled high in a flat tray.

When inverted, the center arch becomes a concave bowl and the sides become pedestal legs. In this form the tray is useful for displaying cheeses, cold cuts, etc. in a deli display case. Lateral slits are cut in the center arch for receiving partitions at any of several positions so that individual smaller bowl sections are available for displaying the products.

BRIEF DESCRIPTION OF THE DRAWINGS

In the drawings which illustrate the preferred embodiment of the invention.

DETAILED DESCRIPTION OF THE PREFERRED EMBODIMENT

Figure 1:
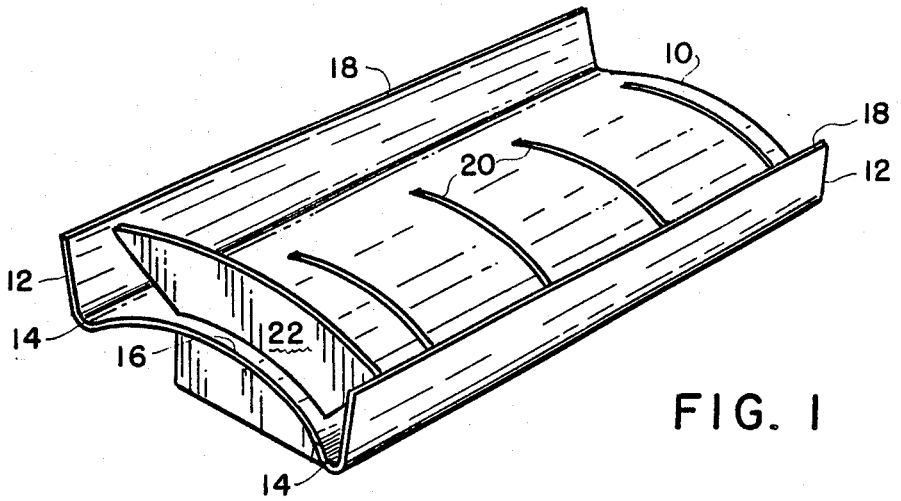
FIG. 1 is a perspective view illustrating the display tray with one partition and with an arched center for drainage of wet products.

The display tray illustrated FIG. 1 may be formed of plastic, glass or stainless or enameled metal and includes an elongated arched center section 10 with longitudinal side walls 12. The center section 10 and side walls 12 are preferably formed of a single plastic or metal plate. The arched center is preferably 20 to 30 inches in length and is designed to hold and display damp food products, such as fish, in a commercial refrigerated display case. The arched center not only appears to an observer to support a large quantity of the damp product but, most important, permits the fluid to drain into the trough 14 formed by the junction of the center section 10 and the side walls 12.

The total width of the display tray is about nine inches and topmost center 16 of the arched center section 10 preferably extends about 1¾ inches above the level of the side troughs 14. The height of the side walls 12 should be the same height so that a straight line drawn between the top edges 18 of the side walls will be tangent to the arched center section. The reason for this will become apparent in connection with FIG. 4 to be described later.

Figure 2:
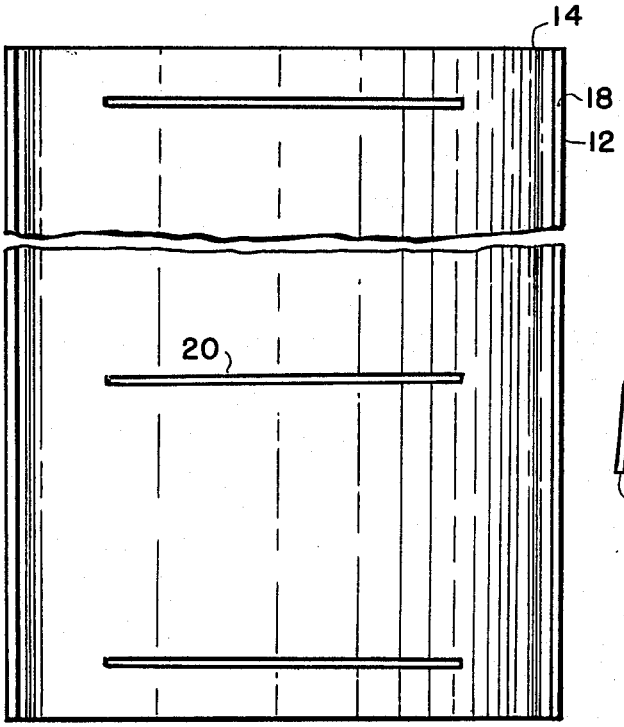
FIG. 2 is a top plan view of the display tray.

As best shown in the plan view of FIG. 2, a plurality of lateral slits 20 are spaced about 4½ inches apart along the center axis of the elongated center section 10. Each slit is about 5½ inches in length and ⅛ inch in width. Into selected slits are inserted ⅛ inch thick fan shaped dividers 22, only one of which is illustrated in an end slit in FIGS. 1 and 3. Positioning of the dividers at desired locations along the arched center of the tray provides partitioned display sections of appropriate sizes for various products. Drainage from the damp products also occurs through unused slits in the tray.

Figure 3:
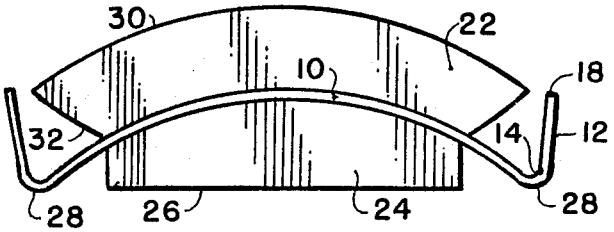
FIG. 3 is an end elevational view of the tray.

As best illustrated in FIG. 3, each divider has a rectangular lower portion 24 that passes through a slit to lock the divider into position. The height of the parallel sides of this rectangular portion should be just adequate to extend from the arched center section 10 to a straight line extending between the curved exterior surfaces 28 of the troughs 14 so that the bottom edge 26 of each divider 24 will rest against a flat surface with the surfaces 28.

The top edge 30 of each divider 22 is preferably curved on the same center as the arcuate arch of the center section 10 so that the curved top edge 30 appears parallel with the curved arch of the center section 10, and the length of top edge 30 should extend to a point approximately above the curved troughs 14.

The short portions of the fan shaped dividers 22 between the rectangular lower portion 24 and the curved top edge 30 is also curved to conform to the curvature of the arched center section 10. The reason for this is best understood from an examination of FIG. 4.

Figure 4:
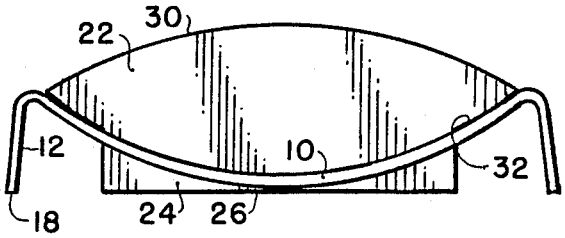
FIG. 4 is an end elevational view of the tray inverted to form a partitioned concave bowl.

FIG. 4 illustrates the display tray inverted for holding and displaying drier deli products that do not require draining. In this configuration, the tray is in the form of an elongated rectangular concave bowl with the same dividers positionable at desired locations along its length. When inverted as shown, the side walls 12 form pedestal side legs the edges 18 of which rest on a flat shelf surface of a display case. Since a line between the side wall edges 18 is tangent to the arch of the center section 10, the arch of the center section will also rest on the flat display case shelf. Similarly the edges 26 of the rectangular section 24 of the dividers 22, will also rest on the shelf surface to provide further support for the display tray.

It will be noted in FIG. 4 that the section 32 between the divider rectangular section 24 and the curved top edge 30 conforms to the curvature of the arched center section 10 so that the short section 32 will closely fit against the arcuate surface of the center section 10.

Having thus described my invention, what is claimed is:

1. A tray for displaying products on both a first and second tray surface, said tray comprising:

an elongated arched central body portion having first and second ends and substantially straight longitudinal sides;

substantially vertical elongated side wall members attached along the straight sides of said body portion, said wall members having a height above said straight sides that correspond to the maximum height of the arch of said central body portion;

a plurality of spaced lateral divider slits through said arched central body portion; and a plurality of fan shaped dividers insertable in selected slits in said central body portion, each of said plurality of dividers having a rectangular bottom portion with a straight lower edge, said rectangular portion passing through a slit to a position at which its straight lower edge is aligned with each attachment of said side wall members with said central body portion.

2. The tray claimed in claim 1 wherein said plurality of lateral divider slits are located substantially in the center of the arched central body portion.

3. The tray claimed in claim 2 wherein said fan shaped dividers have arcuate top edges above and extending substantially across said central body portion.

4. The tray claimed in claim 3 wherein said central body portion is a convex longitudinal arch and said elongated sides form side walls for containing products on said arch, the junction of said sides an said central body portion forming troughs for fluids drained from said products.

5. The tray claimed in claim 3 wherein said central body portion and said elongated sides are inverted to form a elongated concave bowl for containing products, said elongated sides forming pedestal legs for supporting said bowl on an external surface.

6. The tray claimed in claim 5 wherein said pedestal legs, the arched elongated central body portion, and the straight lower edge of a divider rectangular bottom portion simultaneously contact a surface upon which said tray rests.

7. The tray claimed in claim 6 wherein sections of said fan shaped dividers between said rectangular bottom portions and said arcuate top edges are curved to closely lie against the arcuate surface of said central body portion.

8. The tray claimed in claim 2 wherein said elongated arched central body portion and said elongated sides are formed from one sheet of material.

* * * * *